United States Patent [19]

Berz

[11] Patent Number: 4,883,237

[45] Date of Patent: Nov. 28, 1989

[54] WIRE REEL

[75] Inventor: Gerhard Berz, Leverkusen, Fed. Rep. of Germany

[73] Assignee: Sms Schloemann-Siemag Aktiengesellschaft, Dusseldorf, Fed. Rep. of Germany

[21] Appl. No.: 235,033

[22] Filed: Aug. 22, 1988

[30] Foreign Application Priority Data

Aug. 20, 1987 [DE] Fed. Rep. of Germany ..... 3727741

[51] Int. Cl.[4] ..... B21C 47/00

[52] U.S. Cl. ..... 242/83; 72/142

[58] Field of Search ..... 242/81–84; 72/135, 142, 143, 146

[56] References Cited

U.S. PATENT DOCUMENTS

| | | | |
|---|---|---|---|
| 3,542,307 | 11/1970 | Schuetz et al. | 242/83 |
| 3,656,701 | 4/1972 | Dibrell | 242/83 |
| 4,437,620 | 3/1984 | Ozawa | 242/83 |

FOREIGN PATENT DOCUMENTS

| | | |
|---|---|---|
| 1200239 | 9/1965 | Fed. Rep. of Germany . |
| 1395967 | 3/1965 | France . |

*Primary Examiner*—Stuart S. Levy
*Assistant Examiner*—Steven M. DuBois
*Attorney, Agent, or Firm*—Toren, McGeady & Associates

[57] ABSTRACT

A reel for wire with a rotary basket, a reel bottom which can be raised and lowered and a spiral tube which can be raised and lowered and swiveled. The reel bottom has an axially directed projection whose circumference corresponds to the inner diameter of the wire coil to be coiled. The spiral tube is connected to a spiral tube cylinder which also has an outer diameter which corresponds to the inner diameter of the coil. The reel can be operated even at high circumferential speeds without damaging the wire.

7 Claims, 1 Drawing Sheet

WIRE REEL

BACKGROUND OF THE INVENTION

1. Field of the Invention

The present invention relates to a reel or coiler for wire and includes a rotary basket, a reel bottom which can be raised and lowered, and a spiral tube which can be raised and lowered and swiveled.

2. Description of the Prior Art

Reels of the above-described type have an inner pin or an inner drum which has the purpose to ensure that a certain inner diameter of the wire reel is maintained during the coiling of the wire. Particularly at the beginning of coiling the wire coil, it may easily happen if no inner pin or inner drum is present that the front end of the wire is forced into the inner space of the coil which is to be kept free. When the last windings of the wire coil are coiled, the wire has already left the last driver and is only pulled by the reel. At that moment, it could happen without inner pin or inner drum that the wire is coiled with a smaller diameter than the desired inner diameter of the coil.

The reels of the above-described type have the disadvantage that in the case of coils having great weight and the resulting great height of the coils, the inner pins must be made of a corresponding great length. The continuously increasing coiling speeds result in high centrifugal forces, so that it is necessary to make the inner pin of such a high strength that it cannot be bent outwardly. In addition, it may happen that the inner windings which rest against the inner pin are damaged when the finished coil is lifted out. If a coil is not immediately lifted out after being finished, the danger of damage occurring to the inner windings is even further increased because the coil begins to shrink and is pressed tightly against the inner pin, so that the inner windings may be scratched as the coil is lifted out.

It is, therefore, the primary object of the present invention, to improve a reel with rotary basket of the type described above, so that the reel can be used with high rates of rotation without damaging the material to be coiled.

SUMMARY OF THE INVENTION

In accordance with the present invention, the reel bottom has an axially directed projection whose circumference corresponds to the inner diameter of the coil to be coiled. The spiral tube is connected to a spiral tube cylinder which also has an outer diameter which corresponds to the inner diameter of the coil.

The reel according to the present invention eliminates the above-described problems occurring during coiling of the first and last windings. The projection of the reel bottom limits the inner diameter of the first windings. The spiral tube cylinder prevents the last windings from being pulled more tightly together than desired. Accordingly, the reel according to the present invention no longer requires an inner pin or inner drum which is subject to bending at high rates of rotation.

In order to prevent damage to the wire during the coiling procedure when the spiral tube and the spiral tube cylinder are connected to the spiral tube, it is an advantage if the spiral tube cylinder has at the bottom thereof a conically narrowing portion. It is particularly important in this connection that the conical portion is constructed as a ring mounted rotatably on the spiral tube cylinder. The coil should rotate with the same speed as the wire basket, so that no relative rotary movement occurs between the coil and the rotary basket and, thus, friction which would damage the wire is prevented.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

DETAILED DESCRIPTION OF THE INVENTION

Figure 1:
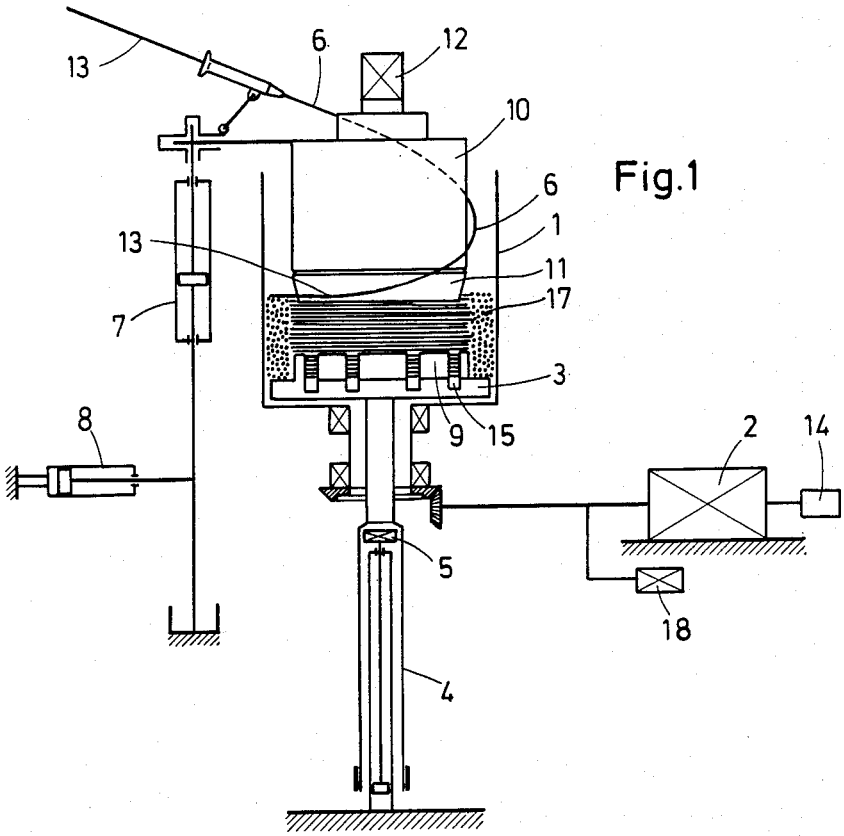
FIG. 1 is a schematic elevational view of a reel according to the present invention.

As illustrated in FIG. 1, the reel includes a rotary basket 1 which can be driven by a motor 2. Rotary basket 1 has a reel bottom 3 which can be raised and lowered by means of a piston-cylinder unit 4. Reel bottom 3 is rotatably mounted at 5 in the piston-cylinder unit 4 and is frictionally driven also by means of motor 2. The reel further includes a spiral tube 6 which can be raised and lowered by means of a piston-cylinder unit 7.

Figure 2:
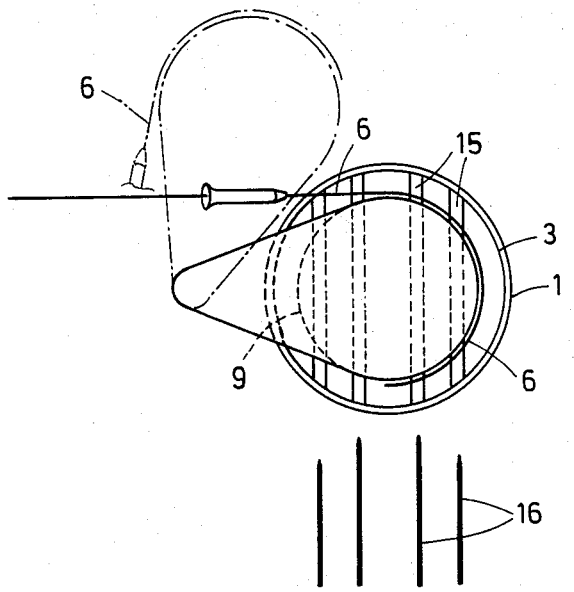
FIG. 2 is a top view of the reel of FIG. 1.

As illustrated in FIG. 2 of the drawing, when the spiral tube 6 is in the raised position, the spiral tube 6 can be swiveled out of the operating position by means of a swivel drive 8.

The reel bottom 3 has an axially directed small projection 9 which prevents the initial windings of the wire coil to have a diameter which is smaller than a certain desired inner diameter. The projection 9 may be a tube of low height. A spiral tube cylinder 10 is connected to spiral tube 6. The lower end of cylinder 10 narrows conically and is formed by a ring 11 which is rotatably mounted on the cylinder 10. The ring 11 is driven by means of a motor 12. Cylinder 10 can be raised and lowered and swiveled together with the spiral tube 6.

The speed at which the wire 13 emerges and the circumferential speed of the rotary basket 1 correspond to each other. The circumferential speed of the rotary basket 1 may be controlled intermittently by means of a tacho-alternator 14 (wobbling).

Projection 9 has parallel slots 15 which are open toward the top and serve to receive a lifting beam 16. Lifting beam 16 is used to lift the wire coil 17 from the reel bottom 3 when the reel bottom 3 is in the raised position. A motor 18 is provided for aligning the slots 15 with the lifting beam 16. Motor 18 slowly swivels the rotary basket and the reel bottom 3 into the position in which the coil is lifted out.

While a specific embodiment of the invention has been shown and described in detail to illustrate the application of the inventive principles, it will be understood that the invention may be embodied otherwise without departing from such principles.

I claim

1. A reel for wire with a wire basket, comprising a reel bottom which can be raised and lowered and a spiral tube cylinder which can be raised and lowered and swiveled relative to the reel bottom, the spiral tube cylinder having a diameter and a lower end, a spiral tube connected to the spiral tube cylinder, the reel bottom having a series of axial projections facing the lower end, the axial projections defining a circumference having a diameter, wherein the diameter of the circumference corresponds to an inner diameter of the wire coil to be coiled, and wherein the diameter of the cylinder also corresponds to the inner diameter of the coil to be coiled.

2. The reel according to claim 1, wherein the a lower end, of the cylinder defines a conically narrowing portion.

3. The reel according to claim 2, wherein the conical portion is a rotary ring.

4. The reel according to claim 3, comprising a motor for driving the conical ring.

5. The reel according to claim 3, comprising means for driving the ring such that the circumferential speed of the ring corresponds to the speed of the wire as it emerges from the spiral tube.

6. The reel according to claim 1, wherein the projections of the reel bottom are formed by a tube of low height.

7. The reel according to claim 1, the reel bottom and the projection defining parallel slots which are open toward the top, the slots serving to receive a lifting beam.

* * * * *